US006105677A

United States Patent [19]

Stager

[11] Patent Number: 6,105,677

[45] Date of Patent: Aug. 22, 2000

[54] METHOD OF EXTINGUISHING STOVETOP GREASE FIRES AND FIRE EXTINGUISHER THEREFOR

[76] Inventor: Daniel J. Stager, 1100 Sweitzer St., Greenville, Ohio 45331

[21] Appl. No.: 09/289,923

[22] Filed: Apr. 12, 1999

Related U.S. Application Data

[60] Provisional application No. 60/084,547, May 7, 1998.

[51] Int. Cl.[7] ..... A62C 2/00

[52] U.S. Cl. ..... 169/47; 169/26; 169/65; 169/DIG. 3; 239/379; 239/524

[58] Field of Search ..... 169/26, 46, 47, 169/54, 42, 65, DIG. 3; 239/379, 456, 505, 506, 518, 524

[56] References Cited

U.S. PATENT DOCUMENTS

| | | | |
|---|---|---|---|
| 1,063,228 | 6/1913 | Thornton | 169/26 |
| 2,749,993 | 6/1956 | Gregg | 169/26 |
| 3,216,506 | 11/1965 | Bakos | 169/26 |
| 3,747,685 | 7/1973 | McCulloch | 169/26 |
| 3,773,111 | 11/1973 | Dunn | 169/65 X |
| 3,884,306 | 5/1975 | Williams | 169/65 X |
| 3,884,307 | 5/1975 | Williams | 169/65 X |
| 4,088,192 | 5/1978 | Lamond | 169/26 X |
| 5,518,075 | 5/1996 | Williams | 169/65 X |
| 5,868,205 | 2/1999 | Cunningham et al. | 169/65 |
| 5,871,057 | 2/1999 | Stehling et al. | 169/65 |

*Primary Examiner*—Andres Kashnikow
*Assistant Examiner*—Steven J. Ganey
*Attorney, Agent, or Firm*—William Weigl

[57] ABSTRACT

A simple, inexpensive container that may be a canister similar to an aerosol spray can is fixedly or pivotally mounted in inverted fashion above a cooking burner. The canister contains a particulate fire suppressant material and has a closable, downwardly-facing opening directed at the burner. A fusible or meltable material maintains a cap that covers the opening in the closed condition at all times except when a flame results from ignition of fat in a pan on the cooking burner. Upon reaching a temperature of 220 degrees F. or above, the fusible material quickly melts, enabling the cap to open, and the fire suppressant material cascades by gravity into the pan and fat, causing it to be extinguished in a matter of seconds. The cap may be guided on a member having a stop at its lower end to capture the cap and prevent it from splashing into the fat upon ejection. Alternatively, the cap may be hinged to the container and be held in place at the hinge once the container is opened. The material cascades over and around the captured cap in the shape of an inverted conical shower, extinguishing the flame. The fat and fire suppressant material combine to minimize flaring-up even though the burner still remains active.

13 Claims, 1 Drawing Sheet

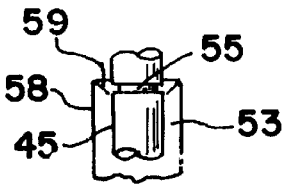
FIG. 3
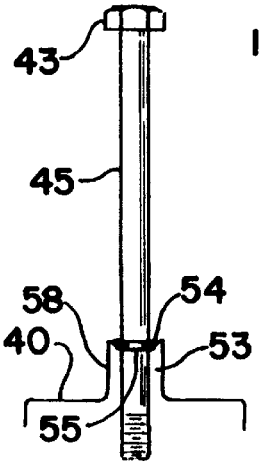
FIG. 4
FIG. 2
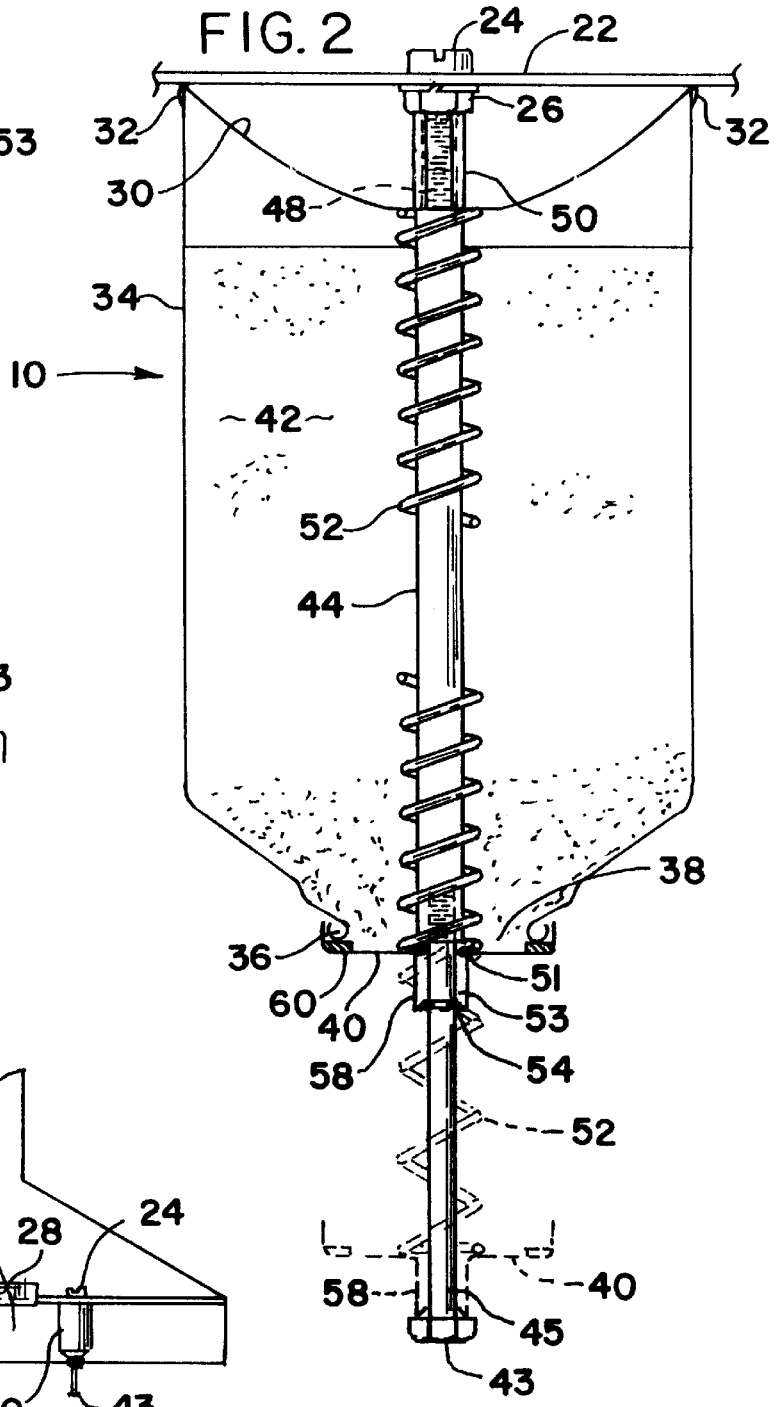
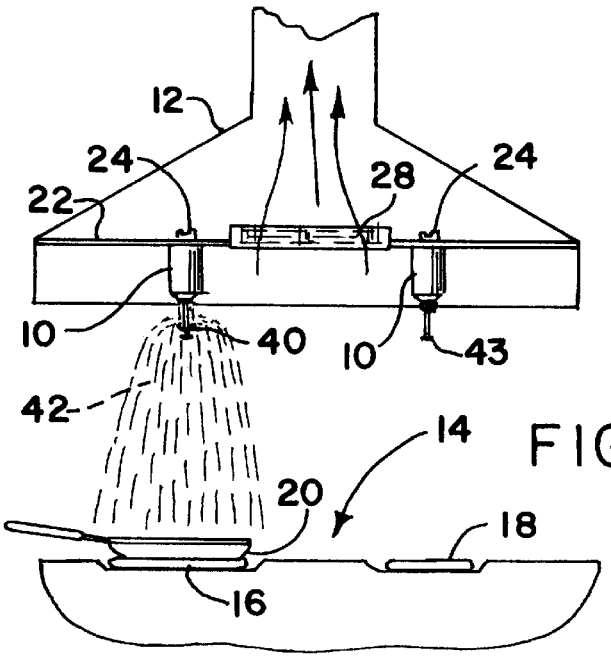
FIG. 1

METHOD OF EXTINGUISHING STOVETOP GREASE FIRES AND FIRE EXTINGUISHER THEREFOR

This application is based upon U.S. Provisional Patent application Ser. No. 60/084547 filed on May 7, 1998.

This invention relates generally to a fire extinguisher and method for putting out grease and cooking oil fires emanating from a pan or similar receptacle on a cooktop stove. In particular, it relates to a device and method for extinguishing the fire in a manner which minimizes the chance of re-ignition or flare-up even though a burner on which the pan rests may continue to operate.

BACKGROUND OF THE INVENTION

Insurance companies can testify to the dangers posed by fires originating from overheating of grease or oils during cooking. Many solutions have been proposed for extinguishing stove grease fires, but none appears to have been adopted to the extent that they are commonly in use. In contrast to extensively-used relatively inexpensive smoke alarms that are fairly simple for an average homeowner to install and are relatively inexpensive, stovetop fire extinguishers are the exception rather than the rule. They are either too complex for the average homeowner to install, are too cumbersome due to having to use cables extending around and above the cooking area, do not adequately fit into the cooking area without inconveniencing the cooking operation, are required to be mounted inside a relatively inaccessible cooking hood or are so costly that they are unaffordable to those persons at the lower end of the economic scale who may have greatest need for an extinguisher.

In addition, where the stove burner is gas operated and is of an age that it lacks an automatic shut-off feature in the event of a flame-out, a pressure-operated fire extinguisher can create a further potential danger. If the pressure happens to extinguish the burner and its pilot, leaking gas presents the possibility of an explosion, either from the fire itself, or from a later spark if the extinguisher puts out the initial fire but gas continues to leak. A pressure operated extinguisher also presents the risk of burning fat being blown out of a pan, spreading the fire to the surrounding area or causing the hot fat to burn an individual in the vicinity.

SUMMARY OF THE INVENTION

A simple, inexpensive container that may be a canister similar to an aerosol spray can is fixedly or pivotally mounted in inverted fashion above a cooking burner. The canister contains a particulate fire suppressant material and has a closable, downwardly-facing opening directed at the burner. A fusible or meltable material maintains a cap that covers the opening in the closed condition at all times except when a flame results from ignition of fat in a pan on the cooking burner. Upon reaching a temperature of 220 degrees F. or above, the fusible material quickly melts, enabling the cap to open, and the fire suppressant material cascades by gravity into the pan and fat, causing it to be extinguished in a matter of seconds. The cap may be guided on a member having a stop at its lower end to capture the cap and prevent it from splashing into the fat upon ejection. Alternatively, the cap may be hinged to the container and be held in place at the hinge once the container is opened. The material cascades over and around the captured cap in the shape of an inverted conical shower, extinguishing the flame. The fat and fire suppressant material combine to minimize flaring-up even though the burner still remains active.

It is a principal object of this invention to provide a simple, inexpensive device and method for extinguishing a grease or fat fire on a stovetop, preferably for use in the home.

Another object is to provide such a fire extinguisher that is simple to install with a single screw on a conventional hood overlying a stove.

More specifically, it is an object of the invention to provide a fire extinguisher for gravity dispensing of a particulate fire suppressant material into a pan having burning fat.

Ancillary thereto, it is an object to dispense the suppressant material in a volume sufficiently large to absorb the cooking oil, thereby rendering it generally non-burnable.

A further object is to provide an inexpensive structure for achieving the foregoing objects, making the device available at nominal cost.

Other objects will become apparent from the following description, in which reference is made to the accompanying drawings.

DESCRIPTION OF THE DRAWINGS

FIG. 1 is a simplified elevational view of a conventional stovetop environment illustrating a pair of fire extinguisher containers mounted on the underside of a hood positioned above the stovetop.

FIG. 2 is a full-size cylindrical canister and all operating parts in cross-section, illustrating the fire extinguisher in solid lines in its inoperative or "ready" condition and portions thereof in dotted lines in its operative "actuated" condition.

FIG. 3 is an enlarged cross-sectional view illustrating the manner in which a cap for the canister is prepared for fastening it to a guide bolt by means of a fusible plug.

FIG. 4 is a subassembly of cap and guide bolt interconnected by means of a fusible plug, ready to be fastened and sealed to a canister.

DESCRIPTION OF A PREFERRED EMBODIMENT

FIG. 1 illustrates the stovetop environment, in which a pair of fire extinguisher containers in the form of canisters 10 are mounted to the underside of a hood 12 positioned above a stovetop 14. While designed primarily for home stovetop use, the structure about to be described is believed suitable for putting out grease or other fires in commercial applications as well. The stovetop is shown simply as having two burners 16 and 18, the former of which is occupied by a frying pan 20 in which fat is being heated either prior to or during cooking. It is immaterial for purposes of this invention whether the burners are gas or electric, but let us assume they are electric and are ordinarily slow to come to full heat. Oftentimes the cook will turn an electric burner to high heat to more rapidly bring the fat to cooking temperature, and will then turn it down to the cooking temperature for a particular food. Suppose, however, a temporary emergency arises, such as a baby or child needing help, a phone call or door bell needing answering, etc., distracting the cook and leaving the burner in its high heat condition longer than it should be. Regardless of the reason, fat fires can start easily under such circumstances. Grease or fat fires create panic because of their suddenness, intensity, potential to do bodily harm to one attempting to put out the fire, as well as run the risk of potential financial loss if the fire cannot be quickly contained by either the individual or a fire department. Such a fire can strike fear in a person who cannot think clearly in an emergency situation, especially if the person is alone and unable to call for help.

Each canister 10 is a self-contained, automatically-actuated fire extinguisher body which can be easily attached to the underside of a bottom wall 22 of the hood 12 by drilling a hole and fixing a downwardly-facing screw 24 in place by means of a nut 26. The canister 10 has a concave end wall 30 with an annular bead 32 where it attaches to a cylindrical body 34. The body is preferably one piece. It extends from the bead 32 to a second annular bead 36 surrounding an opening 38 in what would normally be considered the top of such a can. Facing downwardly in this environment, however, the opening 38 is at the bottom.

A cap 40 covers the opening 38 when in the normal full-line position of FIG. 1 to contain a particulate fire suppressant or extinguishing material 42 therein. Several different dry materials may be useful. The one employed in tests was primarily sodium bicarbonate in a volume of approximately fourteen ounces. A minimum volume of at least six to twelve ounces is believed necessary for this type of application, to enable the material to combine with the burning fat and minimize the chance of re-ignition even though the burner may remain on after the flame has been extinguished. Particle size should be such as to avoid caking. A flow agent may be mixed with the suppressant material under some circumstances to enable free flow of the material 42 from the canister. Early successful tests were conducted with a mixture of fine sodium bicarbonate and sand to assure a steady flow of the suppressant material 42. Depending on the size of the opening and whether a good mechanical assist is used to eject the material 42, sand or its equivalent may be unnecessary. The full-line position of the cap 40 can be said to be the inoperative or "ready" position, where normal cooking can take place without concern of material 42 getting onto the food or stove. Its dotted-line condition shows the operated position the cap 40 assumes when a fire has started and the cap has been ejected downwardly to enable gravitational flow or rain of the material 42 onto the pan 20 and its burning contents. Flow is shown as an inverted conical shower in dotted lines in FIG. 1. In this version of my invention, I have found that the cap 40 acts as a dispersing device to spread the material to the outer edge of the pan 20, causing the flame to appear to be snuffed from the outer edge toward the center of the pan. The particular material 42 selected is preferably one which chemically and or/physically reacts with the fat so as to minimize re-ignition or flare-up in the event the burner remains on after the fire has been extinguished. In the tests conducted, the fire was snuffed in only a few seconds, and the combined fat and material 42 were no longer burnable.

One form of construction that I have found to be inexpensive and effective to accomplish the foregoing is shown in detail in FIGS. 2, 3 and 4. FIG. 2 shows the "ready" inverted position of the canister 10 as it is mounted directly and preferably centrally over a pan and burner, while FIGS. 3 and 4 show certain elements in the upright positions they occupy during assembly and manufacture. A rod 44 extends from the inside surface of the wall 30 to the opening 38. Threaded upwardly into the lower end of the rod 44 is a small diameter guide bolt 45 having a hex head forming a stop 43 at its lowermost end. The rod 44 and bolt 45 present a shoulder where they join. Reduced diameter screw threads 48 on the opposite end of the rod 44 form a shoulder on the end of the rod 44 where the threads pass through the wall 30. The rod 44 is fixed coaxially to the canister 10 by an elongated hex nut 50 having internal threads at opposite ends. When nut 50 is tightened, the rod 44 is held in place in the canister firmly and centrally. The threads at the top end of the nut 50 can also be used to screw the entire unit to the screw 24 fixed in bottom wall 22 of the hood 12, by rotation of the body 34. Proper selection of the lengths of the screw 24, its nut and hex nut 50 will enable the bead 32 of the canister 10 to fit snuggly against the underside of the wall 22. This provides stability to the unit in the event it is accidentally bumped during cooking or cleanup around the stove. The rod 44 and canister body 34 are fixed relative to each other at all times. The cap 40 must be easily movable along the guide bolt 45 between its full-line "ready" condition toward its dotted line "actuated" condition as shown in FIG. 2. An elongated compression spring 52 surrounds the rod 44 and extends between the end wall 30 and the inside of the cap 40, where it passes over and around a small O-ring 51. The diameter of the spring 52 is greater than the compressed diameter of the O-ring 51 so that the O-ring does not inhibit spring expansion when the spring is called upon to extend. The spring is compressed and held in that manner by fixing the cap 40 and guide bolt 45 together. This is done by means of a fusible plug 54 soldered to a necked-down groove 55 around the guide bolt 45, as best seen in enlarged FIG. 3. The solder is a fusible material well known for use in fusible plugs. Such plugs melt when reaching a predetermined temperature and enable operation of a heat responsive device. The particular fusible material selected for this situation can be made to melt within a few degrees of a desired end temperature between 220 to 300 degree F. This is a temperature not reached during cooking, but is one that is promptly reached when a grease fire occurs. The instant the plug 54 melts, the spring 52 ejects the cap 40 downwardly to enable dispersion of the fire suppressant material 42 onto the burning fat. The spring 52 forcibly propels the immediately surrounding particulate material 42 in an outward and downward direction. This gives material flow a rapid start and allows for free flow of the remaining material following the initial rapid propulsion. While the spring 52 is shown to fairly closely surround the rod 44, it may be any shape, size or configuration found most suitable to mechanically assist in ejecting the material 42 from the canister body 34 into the frying pan 20.

It can be seen from FIGS. 3 and 4 that the cap 40 preferably has an outwardly extending neck 58 of larger diameter than the guide bolt 45. The neck 58 terminates in an inwardly-facing indentation or dimple 59 with a cylindrical central hole that closely surrounds and freely guides the cap along the guide bolt 45 during a grease fire. FIG. 3 is an enlarged view of the relative positioning of the cap 40 and guide bolt 45 in a fixture (not shown) just prior to heating of solder which forms the fusible plug 54. Obviously, other means such as a knurl may be substituted for the groove 55, the purpose being to prevent slippage of the cap 40 relative to the bolt 45 except when a fire condition occurs.

After the plug 54 is in place and the subassembly of cap 40 and bolt 45 take the form of FIG. 4, the O-ring 51 is placed around the bolt 45. At this point in time, the canister is almost ready for filling with the material 42, with the opening 38 facing upwardly. Before filling, the female threads in rod 44 which are intended to receive the bolt 45 are first covered by any appropriate means to assure that those threads are kept free of material 42 during the canister filling operation. Once the canister 10 has been filled, compression seal 60 is placed over the bead 36 and a lubricant may be applied to its outer face and to the O-ring 51. The subassembly of FIG. 4 is then screwed into the threads in the end of the rod 44 until both the compression seal and O-ring seal the canister against leakage. This prevents material 42 from escaping when the canister 10 is inverted, and prevents cooking and other moisture from entering the canister and degrading the material. It further maintains the material 42 in a free-flowable state for use when called upon to put out a fire. The O-ring 51 creates a dead air space 53 between the O-ring and the plug 54. This dead air space provides additional assurance that the plug 54, once melted, cannot re-solidify before the cap 40 reaches the stop 43. This is enhanced by virtue of material 42 being kept out of the space 53. The guide bolt 45 is preferably made of a heat-conductive material which retains heat long enough to maintain the plug liquid until the cap reaches its end of travel. The unit is now ready for installation in a hood 12 as shown in FIG. 1.

By utilizing this approach, where multiple extinguishers overlie multiple burners, the fire can be extinguished so rapidly that a unit spaced horizontally from the activated unit may remain untouched by the flame and heat and continue to be usable. Replacement of a spent unit is as easy as turning the canister to unscrew the spent unit and doing the reverse for installing a new unit. Obviously, this is done after necessary clean-up to eliminate any damage caused by the fire.

While I have illustrated the fusible plug as being a conventional solder, I have found ordinary nylon fishing line to also serve as the meltable material where the line merely holds something in place. An alternative design is one where the container is positioned horizontally above the stove, pivotally mounted on a trunnion at its end having the end wall 30 and held in the horizontal position by the nylon line supporting its opposite end. Initially, a grease fire would melt the nylon line first and permit the container to swing downwardly by gravity to the vertical position, comparable essentially to that shown in FIG. 2. Once down, the lower end of the container is nearer to the fire, the fusible plug 54 or its functional equivalent melts and the fire is suppressed as noted earlier. This mode of construction involves sequential operation of the two meltable materials, the first enabling the container to swing from the horizontal to the vertical position, and the second causing release of the cap and extinguishing of the grease fire. Obviously, this sequence requires that the first meltable material respond to the fire heat at a lower temperature than the second. This alternative design allows the extinguisher to be positioned up higher within the hood, further out of the way of the person performing the cooking activities.

Various changes can be made without departing from the spirit and scope of the claims.

having described my invention, I claim:

1. The method of extinguishing a grease or cooking oil fire emanating from a pan of grease on a stovetop burner, comprising the steps of:

positioning a container having a predetermined volume of dry particulate fire suppressant material in a location directly over said burner, said container, when extinguishing the fire, having a downwardly-facing opening and a cap sealing said opening;

providing a heat-responsive fusible means maintaining said cap in sealing relationship with said container, said fusible means having a melting point indicative of a temperature at which grease in said pan on said burner ignites;

releasing said cap from its sealing condition in response to a fire occurring in said pan having reached the melting point of said fusible material to enable primarily downward gravitational flow of fire suppressant material from said container; and continuously dispensing said particulate material into said pan until said container is emptied to rapidly extinguish the flame upon initial contact of the material with the grease and to thereafter combine with said grease in a manner generally inhibiting re-ignition in the event the burner continues to operate in a heating mode.

2. The method according to claim 1 including the step of providing a compression spring within said container and further including the step of both gravitationally and forcibly expelling said particulate material from said container upon release of said cap from its sealing condition.

3. The method according to claim 1 including the additional step of enabling said cap to descend directly vertically to a lower stop position with respect to said opening upon melting of said fusible means, thereby creating an inverted conical shower of cascading material into said pan as the material exits from the opening and contacts the cap.

4. The method according to claim 3 wherein said enabling comprises physically biasing said cap to said lower stop position.

5. The method according to claim 1 wherein the volume of material dispensed is sufficient to absorb the grease or oil and render it generally non-burnable.

6. In a device for extinguishing flame and fire emanating from cooking grease or fat in a cooking receptacle resting on a household stovetop burner, said device comprising:

an inverted container having a vertically-downwardly facing normally-closed opening;

particulate fire suppressant material in said container, said material being capable of smothering and extinguishing the flame when said opening is opened and reacting with the fat so as to minimize the potential for re-ignition after the flame has been extinguished;

means mounting said container adjacent said stovetop in a manner directing said opening toward a position normally occupied by said cooking receptacle during cooking, said mounting means being spaced a distance above said stovetop whereby fire suppressant material will cover said receptacle when said closable opening is opened and said distance being sufficiently removed from said stovetop so as not to interfere with normal cooking activities;

a cap covering the opening and retaining the fire suppressant material within the container;

spring means normally biasing said cap in a direction outwardly of said container;

a fusible member at the exterior of said cap, said fusible member closing and maintaining the cap in the closed position when the temperature around said stovetop is below a predetermined temperature which is indicative of the absence of a fire;

said fusible member consisting of a meltable material having a melting point generally indicative of cooking grease or fat having been ignited and presenting a hazardous fire condition, whereby, upon melting of said meltable material, the cap is urged outwardly of the container to open the opening and enable continuous flow of said fire suppressant material primarily downward by gravity toward and onto said fire until the supply of suppressant material within said container has been exhausted.

7. The invention according to claim 6 wherein said spring means acts to forcibly expel the material from the container when said cap is opened.

8. The invention of claim 6 wherein said container is a cylindrical canister.

9. The invention of claim 8 wherein a rod including a threaded portion passes through a canister end wall opposite the opening, said rod having a guide member threaded therein adjacent said opening, and wherein a nut connecting the rod to said canister also contains a threaded portion for fastening said canister to said mounting means.

10. The invention of claim 9 wherein said cap includes a portion thereof closely fitting said guide member and serving to guide the cap vertically downwardly toward a stop at the lower end of said guide member.

11. The invention of claim 6 wherein a guide member is mounted centrally relative to said container and extends outwardly relative to said cap and wherein an arresting stop is provided on the lower end of said guide member, and wherein said stop inhibits said cap from leaving said guide member upon melting of said meltable material.

12. The invention according to claim 6 wherein the volume of material in said container is sufficient to absorb burning grease or fat and render it generally non-burnable.

13. The invention according to claim 12 wherein said volume is between six and twelve ounces.

* * * * *